United States Patent [19]

Kipp

[11] 3,963,121

[45] June 15, 1976

[54] CARRIER CARTON WITH DISPLAY PANEL

[75] Inventor: Michael A. Kipp, Phoenixville, Pa.

[73] Assignee: Container Corporation of America, Chicago, Ill.

[22] Filed: July 21, 1975

[21] Appl. No.: 597,313

[52] U.S. Cl. ..... 206/434; 229/40; 206/155; 206/165

[51] Int. Cl.[2] ..... B65D 5/02; B65D 75/00

[58] Field of Search ..... 229/40; 206/155, 165, 206/434

[56] References Cited

UNITED STATES PATENTS 3,128,010 7/1964 Forrer ..... 206/155

3,670,950 6/1972 Rossi ..... 206/155

*Primary Examiner*—William Price

*Assistant Examiner*—Douglas B. Farrow

[57] ABSTRACT

An open-ended, sleeve type carrier carton having an advertising display panel foldably connected to an end of the carton top wall and also having a locking tab engageable with the panel to retain it in a generally vertical position.

1 Claim, 3 Drawing Figures

CARRIER CARTON WITH DISPLAY PANEL

SUMMARY OF THE INVENTION

The invention relates to carrier cartons formed of paperboard for enclosing a plurality of articles such as beverage bottles, and particularly to wrap-around cartons of the sleeve style which are open at the ends.

The invention is directed to a carrier carton of the type described which has a relatively narrow, elongated advertising display panel hinged to the end of the carton top wall, and gusset panels foldably connected to the opposite sides of the panel and to the adjacent edges of the carton side walls.

The invention represents an improvement over the structure disclosed in U.S. Pat. No. 3,429,496, which structure includes advertising display panels on the ends of the carton top wall, but which does not include a positive means for locking them in position.

A particular object of the invention is to provide, in a carton of the type described, integrally formed means to maintain the panel in a generally vertical position.

A more specific object of the invention is to provide lock tabs on the gusset panels which project against and engage the display panel to keep it in the desired position.

These and other objects of the invention will be apparent from an examination of the following description and drawings.

THE DRAWINGS

It will be understood that, for purposes of clarity, certain elements may have been omitted from certain views where they are believed to be illustrated to better advantage in other views.

THE SPECIFICATION

Figure 1:
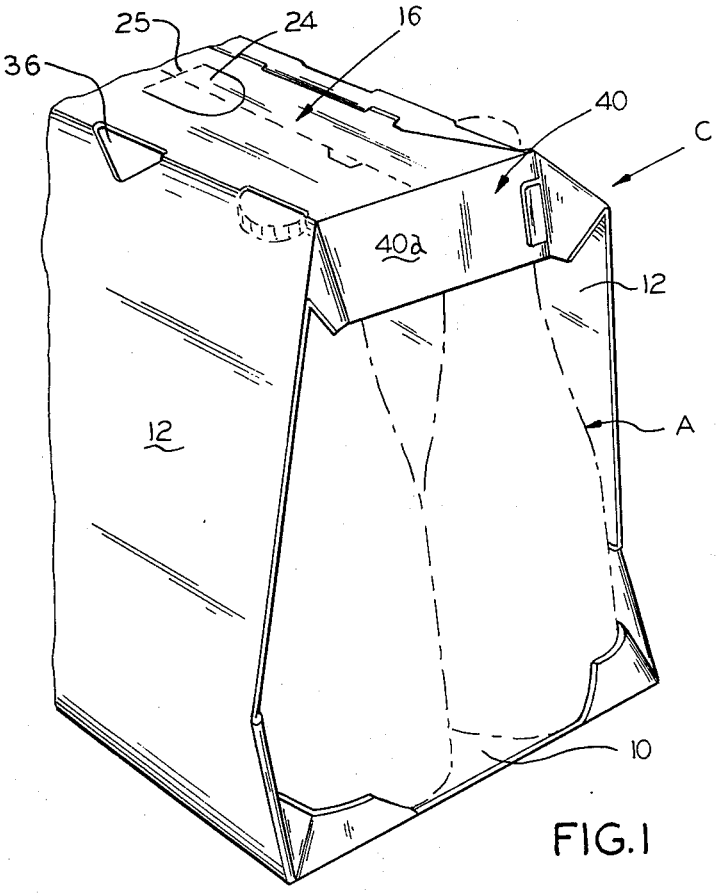
FIG. 1 is a fragmentary perspective view of a carrier carton embodying features of the invention.

Referring now to the drawings, it will be seen that a carton indicated generally at C and embodying features of the invention is shown in FIG. 1. The carton is an open-ended, sleeve type, carrier carton, adapted to enclose a plurality of articles such as beverage bottles indicated generally at A, and may be formed from the unitary blank of foldable paperboard indicated at B in FIG. 3 of the drawings. The novel feature of this invention resides in the manner in which the advertising display panel indicated generally at 40, and described in detail later in the specification, is secured to the carton itself and maintained in proper position. The principles of the invention to the advertising display panel would be suitable for any type of sleeve type, open-ended carton and are not necessarily limited to the specific carton structure illustrated in the drawings.

For illustrative purposes, however, the carton in the drawings is shown as comprising a bottom wall panel 10, a pair of opposed side wall panels 12 foldably connected at their lower edges to opposite side edges of bottom wall panel 10 on fold lines 13, and a pair of top wall panel sections **14*a* and 14*b* foldably connected at their upper edges along fold lines 15 to the upper edges of side wall panels 12 and secured to each other in overlapping relationship to form a composite top wall panel 16.**

Figure 3:
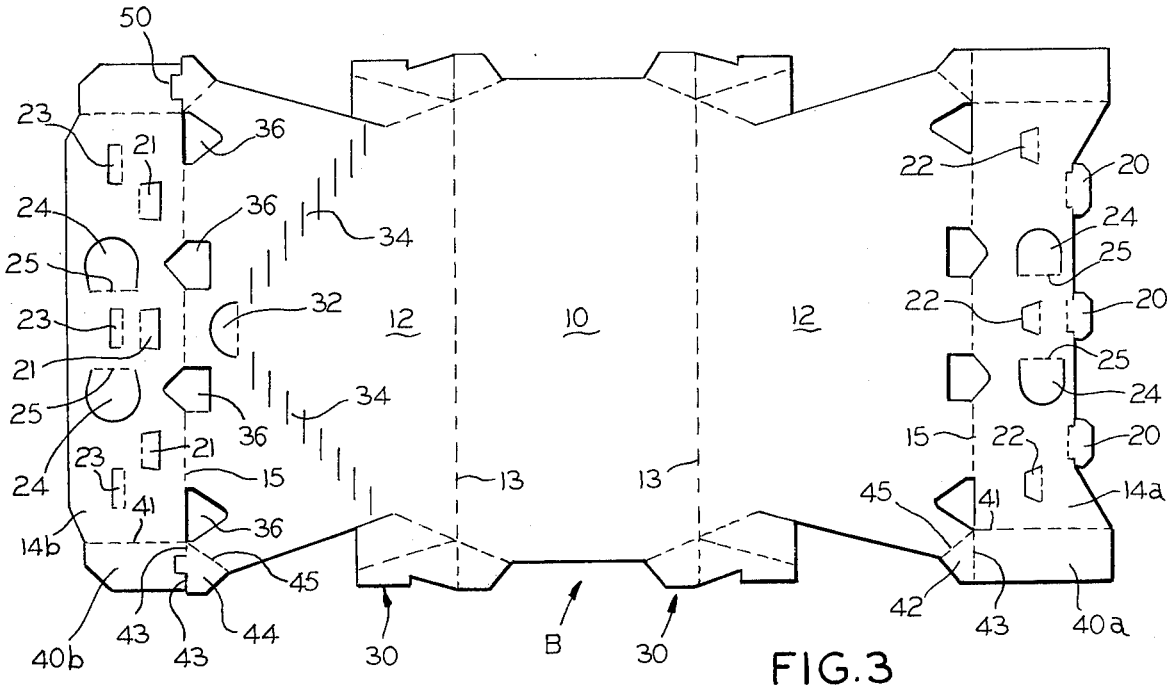
FIG. 3 is a plan view of a blank of sheet material from which the carton illustrated in the other views may be formed.

The specific manner in which the top wall panel sections **14*a* and 14*b* are secured to each other is not an essential feature of the invention. They may be adhesively secured to each other or, as illustrated in the drawings, they may be secured by a interlocking relationship. As best seen in FIG. 3, top wall panel section 14*a* is provided with first and second pairs of male locking tabs 20 and 22 which are adapted to be received within corresponding aligned female locking apertures 21 and 23 presented in the other top wall panel section 14*b*.** Such a locking arrangement is conventional and well known in the art.

Top wall panel sections **14*a* and 14*b* may be provided with aligned pairs of finger hole tabs 24 cut from the panels and hinged thereto on fold lines 25** to provide a means for grasping and holding the carrier carton from the top wall.

Because the ends of the carton sleeve are open, the packaged articles A may be retained within the carton by conventional gusset members indicated generally at 30, which are foldably connected to the end edges of bottom wall panel 10 and side wall panels 12. In order to facilitate opening of the carton, one of the side wall panels 12 may be provided with a pair of weakened lines of tear 34 which diverge downwardly from an aperture 32. This structure is also well known in the art.

In order to more firmly position the packaged articles, which in the case illustrated are beverage bottles, the carton may be provided with a plurality of apertures 36 in the upper portions of the side walls adjacent the top wall, which apertures receive the upper extremities of the packaged articles.

Now referring particularly to FIGS. 1 and 3, it will be seen that display panel sections 40a and 40b are joined to their related side wall panels 12 by means of gusset panels 42 and 44, respectively, which are foldably connected at corresponding side edges to the display panel sections on fold lines 43, and which are foldably connected at other corresponding side edges to related side wall panels 12 on fold lines 45, which are disposed at acute angles relative to fold lines 43.

Figure 2:
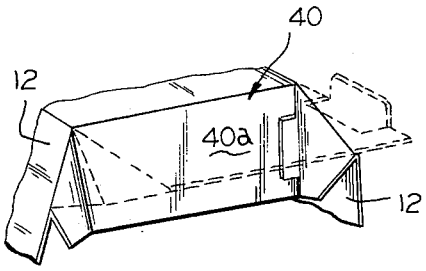
FIG. 2 is an enlarged view of a portion of the structure illustrated in FIG. 1.

As best seen in FIGS. 1 and 2, when the carton is in erected condition, gusset panels 42 and 44 are folded downwardly and inwardly so as to lie inside of their related side wall panels 12 and thereby urge display panels 40 to extend downwardly in generally vertical planes from the end edges of the carton top wall 16.

In order to prevent display panels 40 from popping outwardly from this position, at least one of the gusset panels at each end of the carton is provided with an extension 50 which may be cut from a portion of the material which forms the related top wall panel section. As best seen in FIG. 1, the extension or projection 50 serves as a retaining tab or lock tab as it engages the adjacent edges of display panel 40 and serves to retain it in its proper vertical position.

I claim:

1. In an open ended, sleeve type carrier carton formed from foldable paperboard for holding a plurality of articles arranged in at least one row, the combination of:

a. an opposed pair of top and bottom walls and an opposed pair of side walls foldably joined to each other to form a tubular structure open at the ends thereof;

b. at least one relatively narrow, elongated, advertising display panel foldably connected at its upper edge to an edge of said top wall and disposed to extend outwardly and downwardly therefrom;

c. a pair of gusset panels having certain corresponding side edges foldably connected to opposite side edges of said display panel and having other corresponding edges foldably connected to adjacent edges of respective side walls;

d. said gusset panels being connected to said display panel and said side walls on angularly related fold lines, so that when the carton is in an erected condition, said gusset panels will extend inside of their related side walls and urge said display panel inwardly of said carton tubular structure to a generally vertical position;

e. at least one of said gusset panels having a retaining tab engageable with said display panel to retain it in a generally vertical position;

f. said tab extending outwardly from an edge of said gusset panel immediately adjacent said display panel and being spaced from a side wall, to which said gusset panel is connected, by said gusset panel.

* * * * *